US009355833B2

(12) United States Patent
Tanino et al.

(10) Patent No.: US 9,355,833 B2
(45) Date of Patent: May 31, 2016

(54) EXCIMER LAMP

(71) Applicant: USHIO DENKI KABUSHIKI KAISHA, Tokyo (JP)

(72) Inventors: Kenji Tanino, Himeji (JP); Junya Asayama, Himeji (JP); Yukiharu Tagawa, Himeji (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/763,278

(22) PCT Filed: Nov. 25, 2013

(86) PCT No.: PCT/JP2013/081600

§ 371 (c)(1),
(2) Date: Jul. 24, 2015

(87) PCT Pub. No.: WO2014/119105

PCT Pub. Date: Aug. 7, 2014

(65) Prior Publication Data

US 2015/0364317 A1 Dec. 17, 2015

(30) Foreign Application Priority Data

Jan. 30, 2013 (JP) ..... 2013-014997

(51) Int. Cl.

| | |
|---|---|
| ***H01J 61/26*** | (2006.01) |
| ***H01J 65/00*** | (2006.01) |
| ***H01J 61/36*** | (2006.01) |
| ***H01J 61/44*** | (2006.01) |
| ***H01J 61/54*** | (2006.01) |
| *H01J 7/18* | (2006.01) |

(52) U.S. Cl.

CPC ..... *H01J 61/26* (2013.01); *H01J 61/36* (2013.01); *H01J 61/44* (2013.01); *H01J 61/547* (2013.01); *H01J 65/00* (2013.01); *H01J 7/186* (2013.01)

(58) Field of Classification Search

CPC ..... H01J 61/26; H01J 61/36; H01J 61/44; H01J 61/547; H01J 65/00; H01J 7/186

See application file for complete search history.

(56) References Cited

U.S. PATENT DOCUMENTS 3,748,519 A * 7/1973 Martin ..... H01K 1/54 313/279
5,428,262 A * 6/1995 Geier ..... H01K 1/54 313/548
6,198,223 B1 * 3/2001 Scholz ..... H01J 61/547 313/234

(Continued)

FOREIGN PATENT DOCUMENTS

JP 2006-228563 A 8/2006

OTHER PUBLICATIONS

International Search Report for application No. PCT/JP2013/081600 dated Jan. 8, 2014.

*Primary Examiner* — Donald Raleigh
*Assistant Examiner* — Kevin Quarterman
(74) *Attorney, Agent, or Firm* — Studebaker & Brackett PC

(57) ABSTRACT

Provided is an excimer lamp having a simple and small structure, which can be used in, for example, a refrigerator, and can emit ultraviolet light at a wavelength effective in disinfection processing without generating ozone in a surrounding atmosphere, without leaving gas impurities and moisture in an electrical discharge vessel, and without causing a steep illuminance decrease. A fluorescent substance is disposed on an inner face of the electrical discharge vessel for converting ultraviolet light emitted upon excimer electrical discharge of a light emitting gas to ultraviolet light having a longer wavelength. An inner electrode has a coil shape. A tight winding portion is formed at a certain area of the interior electrode which extends in the center axial direction of the interior electrode such that the coil is tightly wound in the tight winding portion. A getter is attached to the tight winding portion.

16 Claims, 3 Drawing Sheets

(56) References Cited

U.S. PATENT DOCUMENTS

2001/0003411 A1* 6/2001 Honda ..... H01J 61/025 313/607
2002/0185973 A1* 12/2002 Jackson ..... H01J 61/0732 313/607
2015/0035429 A1* 2/2015 Hishinuma ..... C02F 1/325 313/491

* cited by examiner

EXCIMER LAMP

TECHNICAL FIELD

The present invention relates to an excimer lamp having an inner electrode and an outer electrode, and in particular to an excimer lamp that is used for disinfection of hood storage equipment such as a refrigerator.

BACKGROUND ART

When a food is stored in a refrigerator or the like for a long time, the food decays and generates a gas or gases. This can facilitate growth and cultivation of bacteria and fungi (referred to as "germ" hereinafter), generate an offensive smell, and adversely affect other foods in the refrigerator. To avoid such situations, a certain measure is necessary for disinfecting the growing (or grown) germ in the refrigerator. An ultraviolet lamp is often used for this purpose.

One of conventional (common) ultraviolet lamps used for this purpose is a low-pressure mercury lamp. In recent years, use of an excimer lamp is studied because the excimer lamp has a better luminous efficacy than the low-pressure mercury lamp and emits light at a higher light intensity (higher optical output intensity) than the low-pressure mercury lamp. The excimer lamp, however, emits vacuum ultraviolet light which has a wavelength equal to or shorter than 200 nm although it somewhat depends upon a light emitting gas sealed in the lamp. For example, when a xenon gas is sealed in the excimer lamp as the light emitting gas, the excimer lamp emits vacuum ultraviolet light having a dominant wavelength at 172 nm. If this vacuum ultraviolet light is used in the refrigerator as it is, the vacuum ultraviolet light creates ozone in the air inside the refrigerator, and adversely affects a human body. Thus, the vacuum ultraviolet light cannot be used as it is.

In view of such fact, it is preferred that a fluorescent substance or phosphor is disposed on an inner surface of an electric discharge vessel of the excimer lamp such that the vacuum ultraviolet light having a wavelength equal to or shorter than 200 nm, which is generated upon excimer light emission in the electric discharge space, is converted to ultraviolet light having a wavelength between 230 nm and 250 nm, which is longer than the wavelength of the vacuum ultraviolet light, and the resulting light is emitted to the outside. By doing so, no ozone is generated in the air inside the refrigerator. The ozone is harmful to the human body. Also, it is possible to generate light having a peak wavelength between 230 nm and 250 nm which is effective for disinfecting colon bacilli, *Staphylococcus aureus* and the like.

However, if the fluorescent substance is provided on the inner surface of the electric discharge vessel of the excimer lamp, the fluorescent substance is exposed to the spark plasma. As a result, a problem arises, i.e., gas impurities and/or moisture is generated from the fluorescent substance, and they may remain in the electric discharge vessel. If the gas impurities and moisture remain in the electric discharge space, the irradiance steeply drops and therefore the disinfection capability decreases. Thus, a problem arises, i.e., sufficient disinfection is not performed. In addition, if sufficient disinfection should be performed, a disadvantage arises, i.e., the disinfection time should be extended.

On the other hand, there is a technique to remove gases and moisture by means of a getter disposed in the excimer lamp. For example, Japanese Patent Application Laid-Open Publication No. 2006-228563 (Patent Literature 1) discloses a technique to provide an inner tube in an electric discharge vessel and provide a getter in the inner tube. This conventional technique, however, requires provision of the inner tube inside the electric discharge vessel among other requirements, and therefore the electric discharge vessel has a complicated inner structure. It is troublesome to fabricate such electric discharge vessel. In an alternative configuration, a separate getter chamber is provided in the electric discharge vessel, which is separate from the light emitting space. In this configuration, the electric discharge vessel has to have a long length, and the inner structure of the electric discharge vessel becomes complicated.

In order to perform the disinfecting treatment in the refrigerator, downsizing of the lamp is necessary, and the lamp has to have a simple structure. The above-mentioned structures are not suitable for use in the refrigerator. Thus, there is a demand for an excimer lamp that can be used in the refrigerator, i.e., an excimer lamp having a small and simple structure, and causing no steep decrease in the irradiance of the emitted light.

LISTING OF PRIOR ART REFERENCES

Patent Literatures

Patent Literature 1: Japanese Patent Application Laid-Open Publication No. 2006-228563

SUMMARY OF THE INVENTION

Problems to be Solved by the Invention

An object of the present invention is to provide an excimer lamp that is used in, for example, a refrigerator and includes a pair of electrodes, i.e., an inner electrode disposed in an electric discharge vessel and an outer electrode disposed outside the electric discharge vessel, with an excimer light emission gas being sealed in the electric discharge vessel. The excimer lamp has a small and simple structure but can emit ultraviolet light having a wavelength effective for disinfection treatment without generating ozone in a surrounding atmosphere and without leaving gas impurities and moisture in the electric discharge vessel, and without causing a speed decrease in the irradiance.

Solution to the Problems

In order to overcome the above-mentioned problems, one aspect of the present invention provides an excimer lamp that includes an electric discharge vessel, a fluorescent substance or phosphor disposed on an inner face of the electric discharge vessel for converting ultraviolet light, which is generated upon excimer discharge of a light emitting gas sealed in the electric discharge vessel, to another ultraviolet light having a longer wavelength, an inner electrode having a coil shape such that a densely wound portion (tight winding portion) of the coil is formed at a predetermined part in an axial direction of the inner electrode, and a getter attached to the densely coil-wound portion.

The getter may include a metallic container having a hollow rod shape, and a getter material supported in the metallic container. A longitudinal direction of the getter may extend in a direction substantially perpendicular to a longitudinal direction of the inner electrode.

An anchor part may be provided at the densely coil-wound portion for holding and securing the inner electrode.

One end (first end) of the electric discharge vessel may be sealed by a metal foil, and a chip portion may be provided at the other end (second end) of the electric discharge vessel.

One end (first end) of the inner electrode may be electrically connected to the metal foil, and sealed in the electric discharge vessel. The opposite end (second end) of the inner electrode may be received in the chip portion. The densely coil-wound portion may be formed at a position offset toward the second end of the inner electrode.

Advantages of the Invention

The excimer lamp of the present invention includes the getter that is directly attached to the coil body, which constitutes the inner electrode. Therefore, it is not necessary to separately provide an inner tube and a getter chamber. As such, the excimer lamp can have a simple structure.

Because the getter is provided on the densely wound portion of the coil of the coil-shaped inner electrode, the densely coil-wound portion becomes a high temperature. This facilitates the activation of the getter, and brings about an advantage, i.e., the activation temperature of the getter is maintained.

Because the fluorescent substance is provided in the electric discharge vessel in the above-described manner, it is ensured that no ozone is generated, and it is possible to generate the ultraviolet light having a wavelength that is effective for disinfection treatment. Further, even if the getter is disposed in the electric discharge vessel to absorb the gas impurities and moisture from the fluorescent substance, it is possible to allow the excimer lamp to have a small and simple structure.

The getter has the metallic container having the hollow rod shape, and the getter material is supported in the metallic container. Also, the longitudinal direction of the getter is perpendicular to the longitudinal direction of the inner electrode. Therefore, the opposite ends of the metallic container are situated close to the outer electrode, and the getter can serve as an auxiliary electrode at the time of power feeding and startup of the excimer lamp. This facilitates (improves) the startup performance of the excimer lamp.

The anchor part is provided at the densely coil-wound portion, and the getter is attached to the densely coil-wound portion. The anchor part is configured to hold and secure the coil-shaped inner electrode. Therefore, the inner electrode is not deformed or displaced by a load of the getter. It is possible to secure the inner electrode at a desired position in a preferred manner.

The densely coil-wound portion is formed at the position closer to the second end of the inner electrode, at which the chip portion is provided, than the first end of the inner electrode, at which the sealing portion is provided. Therefore, the getter attached to the densely coil-wound portion receives a minimum influence of heat generated upon heating and sealing the first end of the inner electrode with the sealing portion.

DETAILED DESCRIPTION OF THE INVENTION

Figure 1:
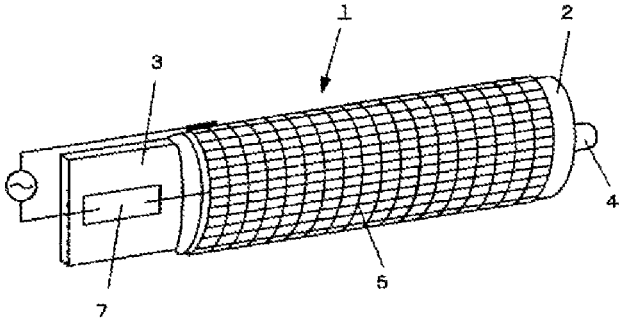
FIG. 1 is a perspective view showing an outer appearance of an excimer lamp according to one embodiment of the present invention.
Figure 2:
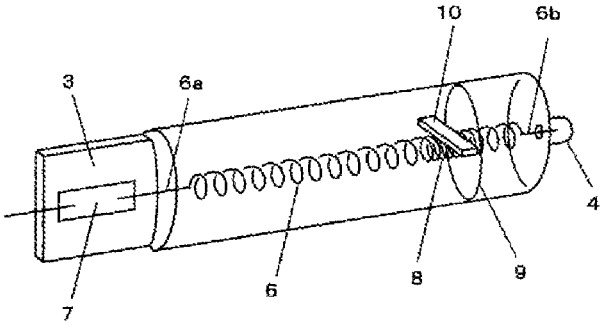
FIG. 2 is a transparent perspective view of FIG. 1.

FIG. 1 illustrates a perspective view of an outer appearance of an excimer lamp according to one embodiment of the present invention, and FIG. 2 is a partly transparent perspective view of the excimer lamp without an outer electrode.

The excimer lamp 1 has a sealing portion 3 that seals one end of an electric discharge vessel 2. A chip portion 4 is provided at the other end of the electric discharge vessel 2. The chip portion 4 is part of a ventilation element. Preferably, the electric discharge vessel 2 is made from a material that has a high absorptivity (absorptive power) to vacuum ultraviolet light. For example, soda lime glass, ozoneless silica glass (quartz glass) or fused silica glass may be used as a material of the electric discharge vessel 2.

Figure 4:
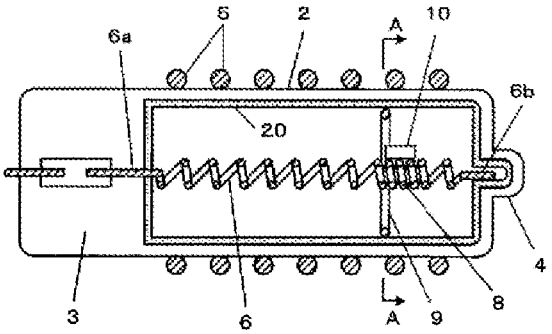
FIG. 4 is a cross-sectional view of the excimer lamp according to the embodiment of the present invention together with the line A-A.

An outer electrode 5 is provided over an outer surface of the electric discharge vessel 2. The outer electrode 5 has, for example, a net shape. An inner electrode 6 is disposed in the electric discharge vessel 2 such that the inner electrode 6 extends in a longitudinal direction of the electric discharge vessel 2. As shown in FIGS. 1 and 4, the inner electrode 6 has a coil shape. One end 6*a* of the inner electrode 6 is electrically connected to a metal foil 7 embedded in the sealing portion 3, and the other end 6*b* of the inner electrode 6 is received in the chip portion 4.

A noble gas is sealed in the electric discharge vessel 2. For example, the noble gas may include xenon (Xe) gas, krypton (Kr) gas, argon (Ar) gas, or neon (Ne) gas. One of these gases may be used, or a suitable combination of these gases may be used as the noble gas.

Figure 3:
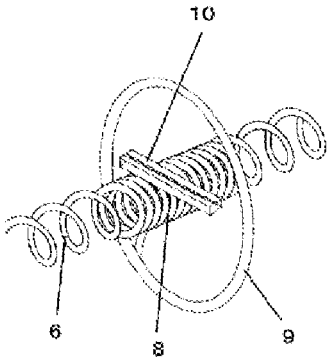
FIG. 3 is an enlarged perspective view of major parts shown in FIG. 2.

As illustrated in FIGS. 2 to 4, the coil-shaped inner electrode 6 has a densely wound portion 8, which has a smaller winding pitch at a certain portion in the longitudinal direction thereof.

As shown in FIGS. 2 and 4, the densely wound portion 8 of the coil is formed at a position offset toward the chip portion 4 in the longitudinal direction. An anchor part 9 is provided at the densely coil-wound portion 8 to hold the coil-shaped inner electrode 6.

As illustrated in FIGS. 2 and 3, a getter 10 is attached to the densely coil-wound portion 8.

Figure 5:
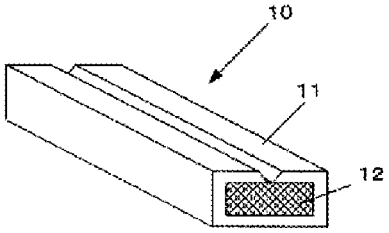
FIG. 5 is a perspective view of a getter.

As depicted in FIG. 5, the getter 10 has a metallic container 11 having a hollow rod shape, and a getter material 12 received in the metallic container 11.

For example, the getter material 12 may be titanium, zirconium, niobium, vanadium, iron, yttrium, hafnium or the like, or may be an alloy containing any of these elements. The activation temperature of the getter may be between 300 degrees C. and 700 degrees C. inclusive.

Figure 6:
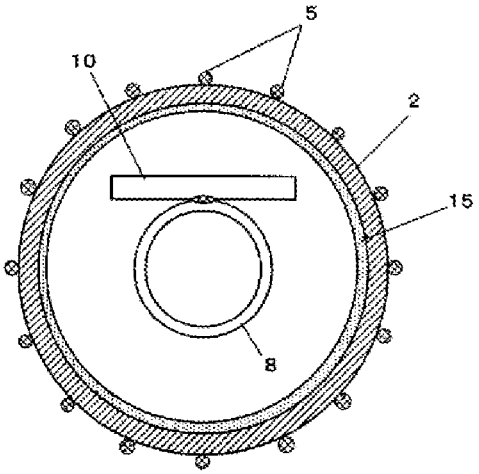
FIG. 6 is a cross-sectional view taken along the line A-A in FIG. 4.

The getter 10 is mounted on the densely wound portion 8 of the coil-shaped inner electrode 6 by welding or the like such that the getter 10 extends in a direction substantially perpendicular to the inner electrode 6. As shown in FIG. 6, this arrangement allows the opposite ends of the getter 10 to be situated in the vicinity of the outer electrode 5. As such, the distance between the getter 10 and the outer electrode 5 is small. As a result, the getter 10 serves as an auxiliary electrode for facilitating the startup of the lamp, and improves the startup performance of the lamp.

On the other hand, as shown in FIGS. 4 and 6, a fluorescent substance or phosphor 15 is provided on the inner face of the electric discharge vessel 2. The fluorescent substance 15 converts the vacuum ultraviolet light having a wavelength of, for example, 172 nm generated upon excimer discharge of the light emitting gas sealed in the electric discharge vessel 2 to ultraviolet light having a longer wavelength of, for example, 230 nm to 250 nm.

The fluorescent substance may be $YPO_4$:Nd, $LiYP_4O_{12}$:Pr, $LaPO_4$:Pr, $LaPO_4$:Pr, $YAl_3B_4O_{12}$, $YAl_3B_4O_{12}$:Bi, $LaPO_4$:Ce, $LaMgAl_{11}O_{19}$:Ce, or the like.

In the excimer lamp having the above-described structure, the light emitting gas such as the xenon gas sealed in the electric discharge vessel 2 emits the vacuum ultraviolet light having a wavelength of, for example, 172 nm upon excimer discharge generated between the outer electrode 5 and the inner electrode 6. The vacuum ultraviolet light is converted to the ultraviolet light having a wavelength of, for example, 230-250 nm by the fluorescent substance 15, and the resulting light is radiated to the outside.

When the resulting light is radiated to the outside, the fluorescent substance 15 releases gas impurities and/or moisture. However, the gas impurities and moisture are absorbed by the getter 10, and do not remain in the electric discharge vessel 2.

Because the getter 10 is provided at the densely wound portion 8 of the coil-shaped inner electrode 6, the getter 10 is activated by the densely wound portion 8 that has a higher temperature than the remaining portion of the inner electrode. Also, the activation temperature is maintained by the densely wound portion.

The getter 10 is arranged such that the getter 10 crosses the longitudinal direction of the inner electrode 6 at substantially right angles. As such, the two ends (opposite ends) of the getter 10 are close to the outer electrode 5, and therefore the getter 10 functions as an element for assisting (facilitating) the startup. This contributes to an improvement in the lamp startup performance.

The anchor part 9 is provided at the densely coil-wound portion 8. Thus, the coil-shaped inner electrode 6 does not deform even if the load is applied to the coil-shaped inner electrode 6 upon mounting the getter 10 onto the densely coil-wound portion 8.

Because the densely coil-wound portion 8 of the inner electrode 6 is formed closer to the chip portion 4 than the sealing portion 3, the getter 10 mounted on the densely coil-wound portion 8 is not influenced by the heat when the sealing portion 3 is heated and sealed.

As described above, the present invention employs a structure that attaches the getter to the densely wound portion of the coil-shaped inner electrode. Thus, realized is the excimer lamp having a compact and simple configuration. In addition, the excimer lamp does not generate ozone, and is suitable for use in a food storage device such as a refrigerator because the excimer lamp emits ultraviolet light having a disinfection capability.

REFERENCE NUMERALS AND SYMBOLS

1: Excimer lamp
2: Electric discharge vessel
3: Sealing portion
4: Chip portion
5: Outer electrode
6: Inner electrode
7: Metal Foil
8: Densely wound portion
9: Anchor part
10: Getter
11: Rod-like hollow container
12: Getter material
15: Fluorescent substance

What is claimed is:

1. An excimer lamp comprising:

an electric discharge vessel having an inner face;

an inner electrode disposed in the electric discharge vessel, the inner electrode having a coil shape;

an outer electrode disposed outside the electric discharge vessel, with an excimer light emitting gas being sealed in the electric discharge vessel;

a fluorescent substance disposed on the inner face of the electric discharge vessel for converting ultraviolet light, which is generated upon excimer discharge of said excimer light emitting gas between the inner electrode and the outer electrode, to another ultraviolet light having a longer wavelength than said ultraviolet light;

a densely coil-wound portion formed in a predetermined part of the inner electrode; and a getter attached to the densely coil-wound portion.

2. The excimer lamp according to claim 1, wherein the getter includes a metallic container having a hollow rod shape, and a getter material supported in the metallic container, and a longitudinal direction of the getter extends in a direction substantially perpendicular to a longitudinal direction of the inner electrode.

3. The excimer lamp according to claim 1 further including an anchor part provided at the densely coil-wound portion for holding and securing the inner electrode.

4. The excimer lamp according to claim 1 further including a metal foil for sealing one end of the electric discharge vessel, and a chip portion provided at the other end of the electric discharge vessel, wherein a first end of the inner electrode is electrically connected to the metal foil, and sealed in the electric discharge vessel, and a second end of the inner electrode, which is opposite the first end, is received in the chip portion.

5. The excimer lamp according to claim 2 further including an anchor part provided at the densely coil-wound portion for holding and securing the inner electrode.

6. The excimer lamp according to claim 2 further including a metal foil for sealing one end of the electric discharge vessel, and a chip portion provided at the other end of the electric discharge vessel, wherein a first end of the inner electrode is electrically connected to the metal foil, and sealed in the electric discharge vessel, and a second end of the inner electrode, which is opposite the first end, is received in the chip portion.

7. The excimer lamp according to claim 3 further including a metal foil for sealing one end of the electric discharge vessel, and a chip portion provided at the other end of the electric discharge vessel, wherein a first end of the inner electrode is electrically connected to the metal foil, and sealed in the electric discharge vessel, and a second end of the inner electrode, which is opposite the first end, is received in the chip portion.

8. The excimer lamp according to claim 4, wherein the densely coil-wound portion is provided at a position offset toward the second end of the inner electrode.

9. The excimer lamp according to claim 6, wherein the densely coil-wound portion is provided at a position offset toward the second end of the inner electrode.

10. The excimer lamp according to claim 7, wherein the densely coil-wound portion is provided at a position offset toward the second end of the inner electrode.

11. The excimer lamp according to claim 1, wherein said ultraviolet light is vacuum ultraviolet light.

12. The excimer lamp according to claim 11, wherein the electric discharge vessel is made from a material having a high absorptivity to the vacuum ultraviolet light.

13. The excimer lamp according to claim 1, wherein said ultraviolet light has a wavelength of 172 nm, and said another ultraviolet light has a wavelength between 230 nm and 250 nm inclusive.

14. The excimer lamp according to claim 1, wherein the excimer light emitting gas includes a noble gas.

15. The excimer lamp according to claim 1, wherein opposite ends of the getter are situated close to the outer electrode.

16. The excimer lamp according to claim 1, wherein the getter is configured to serve as an auxiliary electrode to facilitate startup of the excimer lamp.

* * * * *